US006975291B2

(12) United States Patent
Chan et al.

(10) Patent No.: US 6,975,291 B2
(45) Date of Patent: Dec. 13, 2005

(54) METHOD FOR GENERATING UNIFORM LUMINOSITY FOR AREA COLOR ORGANIC LIGHT EMITTING DIODE

(75) Inventors: Yung-Chou Chan, Beidou Jen (TW); Chih-Chung Chien, Taichung (TW)

(73) Assignee: Wintek Corporation, Taichung (TW)

( * ) Notice: Subject to any disclaimer, the term of this patent is extended or adjusted under 35 U.S.C. 154(b) by 354 days.

(21) Appl. No.: 10/330,293

(22) Filed: Dec. 30, 2002

(65) Prior Publication Data

US 2004/0125054 A1 Jul. 1, 2004

(30) Foreign Application Priority Data

Dec. 31, 2001 (TW) ..... 90133354 A

(51) Int. Cl.[7] ..... G09G 3/30

(52) U.S. Cl. ..... 345/76; 345/46; 345/82; 315/169.1; 315/169.3

(58) Field of Search ..... 345/76–77, 82–83, 345/45–46, 88–89; 315/169.1, 169.3

(56) References Cited

U.S. PATENT DOCUMENTS 5,252,959 A * 10/1993 Kono ..... 345/694
2001/0050662 A1 * 12/2001 Kota et al. ..... 345/76
2003/0058198 A1 * 3/2003 Moon ..... 345/76

* cited by examiner

*Primary Examiner*—Alexander Eisen
*Assistant Examiner*—Kimnhung Nguyen
(74) *Attorney, Agent, or Firm*—Birch, Stewart, Kolasch & Birch, LLP

(57) ABSTRACT

A novel driving method targeting area color organic light emitting diode display devices aims at resolving the problems of poor color balance and uneven luminosity on the display panel resulting from different luminous materials.

6 Claims, 5 Drawing Sheets

METHOD FOR GENERATING UNIFORM LUMINOSITY FOR AREA COLOR ORGANIC LIGHT EMITTING DIODE

This nonprovisional application claims priority under 35 U.S.C. § 119(a) on Patent Application No. 090133354 filed in TAIWAN, R.O.C. on Dec. 31, 2001, which is herein incorporated by reference.

FIELD OF THE INVENTION

The present invention relates to a displaying technique for organic light emitting diode (OLED) and particularly a method for generating uniform luminosity and improved color balance for area color OLED display devices by controlling driver signals of various luminous materials in the diodes.

BACKGROUND OF THE INVENTION

According to color classification, OLED display devices may be grouped in monochrome type, area color type and full color type. The area color OLED display device consists of a plurality of monochrome display areas. Each display area is made from a selected monochrome luminous material. As every luminous material has different luminous efficiency, its luminosity also is different. As a result, the luminosity evenness and the color balance of the display panel are not desirable. This is the main problem now existing in the area color OLED display devices.

To resolve this problem, the most direct approach is to provide a separated and independent driving voltage or current to each luminous material. However such an approach requires to develop a driver circuit for each material. This not only increases the hardware cost, it is also not suitable for mass production. Thus its applicability is not high in the industry.

SUMMARY OF THE INVENTION

The primary object of the invention is to resolve the aforesaid problems of poor color balance and uneven luminosity that occur to the area color OLED display panel resulting from different materials. The invention provides a software design to enhance the uniform luminosity of the entire display panel without increasing the hardware cost.

In order to achieve the foregoing object, the method to achieve uniform luminosity for area color OLED display devices of the invention includes: obtaining the luminous efficiency Pi of every luminous material, and calculating the least common multiple Pm based on the luminous efficiency Pi; next, evenly dividing the original scanning cycle T of the scanning line driver circuit to Pm sub-scanning cycles to allow the scanning line driver circuit to scan sequentially and respectively all of the scanning lines in the Pm sub-scanning cycles; the scanning line driver circuit sequentially providing data signals to data lines in every sub-scanning cycle to drive every luminous material, and every luminous material being driven Pm/Pi times in the scanning cycle T.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Figure 1:
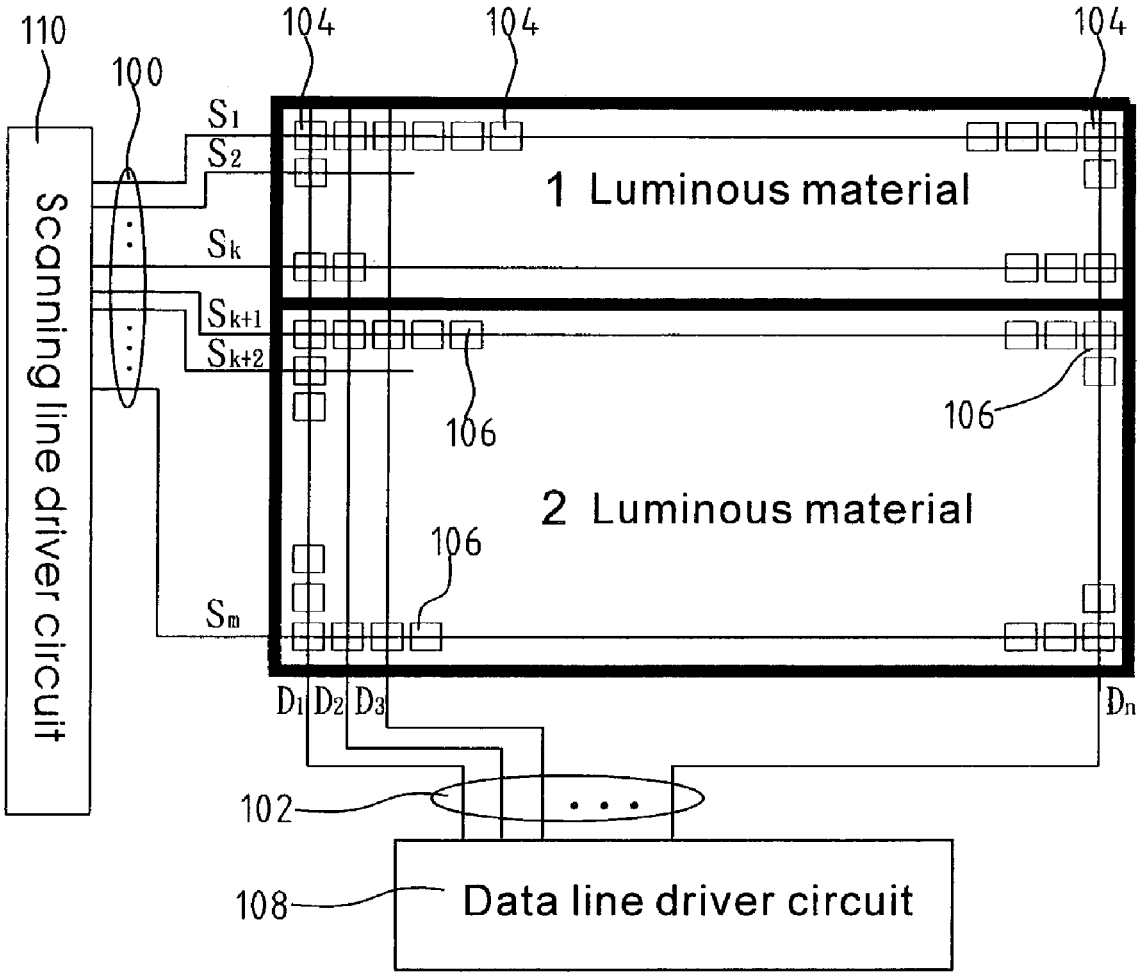
Fig . 1 Prior Art
FIG. 1 is a schematic view of a driver circuit of a conventional area color OLED display device.

Refer to FIG. 1 for a driver circuit of a conventional area color OLED display device. The display device may be a passive OLED display device or an active OLED display device that includes a plurality of scanning lines 100, a plurality of data lines 102 and a plurality of luminous materials (or pixels) 104 and 106 driven by the scanning lines 100 and the data lines 102. Based on the present OLED technology, the red, blue and green light materials have been developed, while other luminous materials are under development. FIG. 1 also includes a data line driver circuit 108 to provide data signals to the data lines 102, and a scanning line driver circuit 110 to provide scanning signals to all scanning lines 100. The scanning line driver circuit 110 has a scanning cycle T to periodically scan all scanning lines 100. The scanning line driver circuit 110 may scan sequentially or alternately. Either way may be adopted to the invention.

Figure 2:
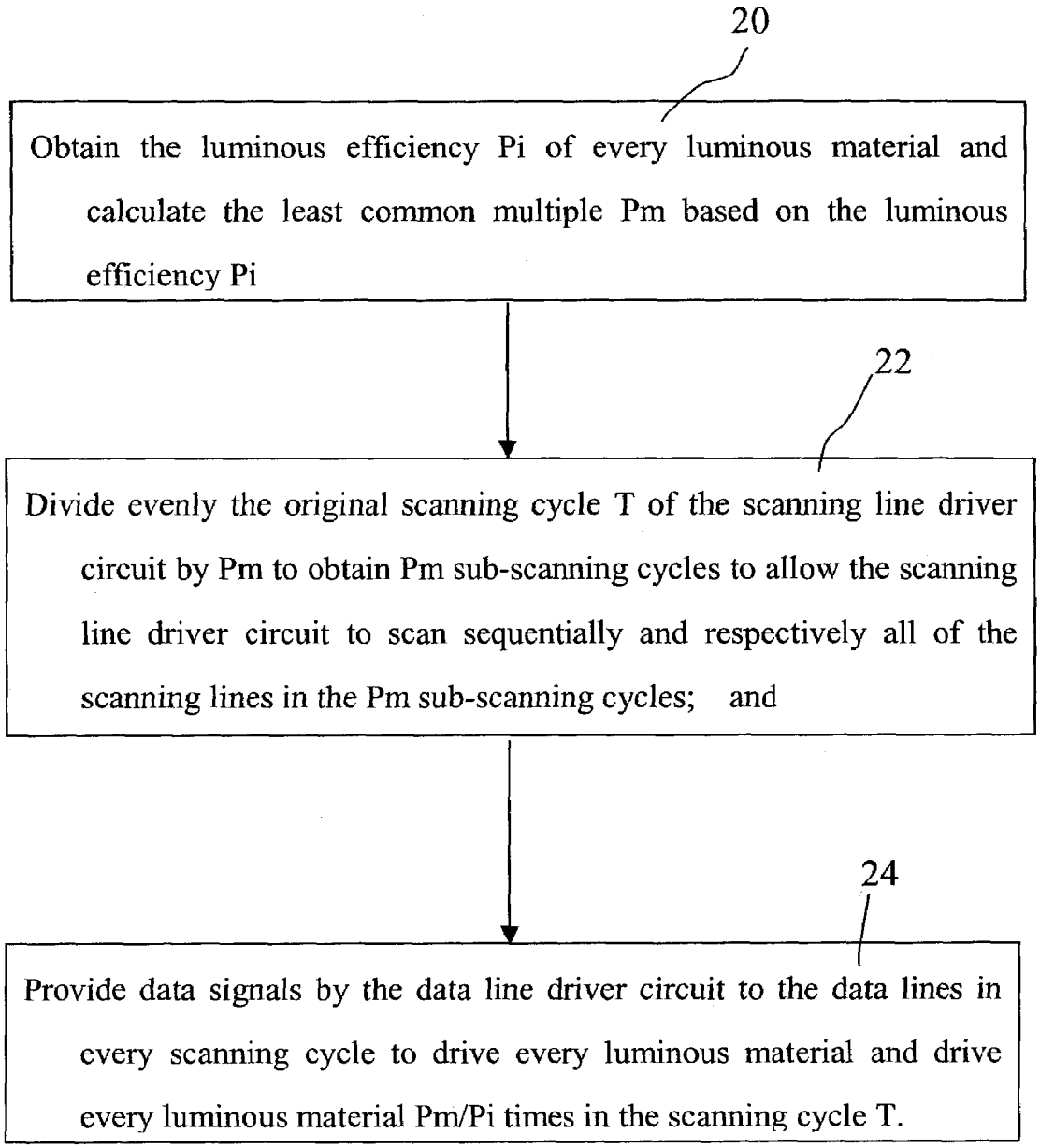
FIG. 2 is the process flow chart of the method of the invention.

Refer to FIG. 2 for the process flow of the invention. First, at step 20, obtain the luminous efficiency Pi of every luminous material, and calculate the least common multiple Pm based in the luminous efficiency Pi. Next, at step 22, evenly divide the original scanning cycle T of the scanning line driver circuit 110 by the least common multiple Pm to obtain Pm sub-scanning cycles to allow the scanning line driver circuit 110 to scan sequentially and respectively all of the scanning lines 100 in the Pm sub-scanning cycles. Finally, at step 24, based on every luminous efficiency Pi obtained at step 20, the data line driver circuit 108 sequentially provides data signals to the data lines 102 in every sub-scanning cycle to drive every luminous material, and every luminous material is driven Pm/Pi times in the scanning cycle T. The step 22 and 24 adopt software design to control the scanning signals and the data signals that drive the luminous materials in the display device to achieve the effect of the invention.

Figure 3A:
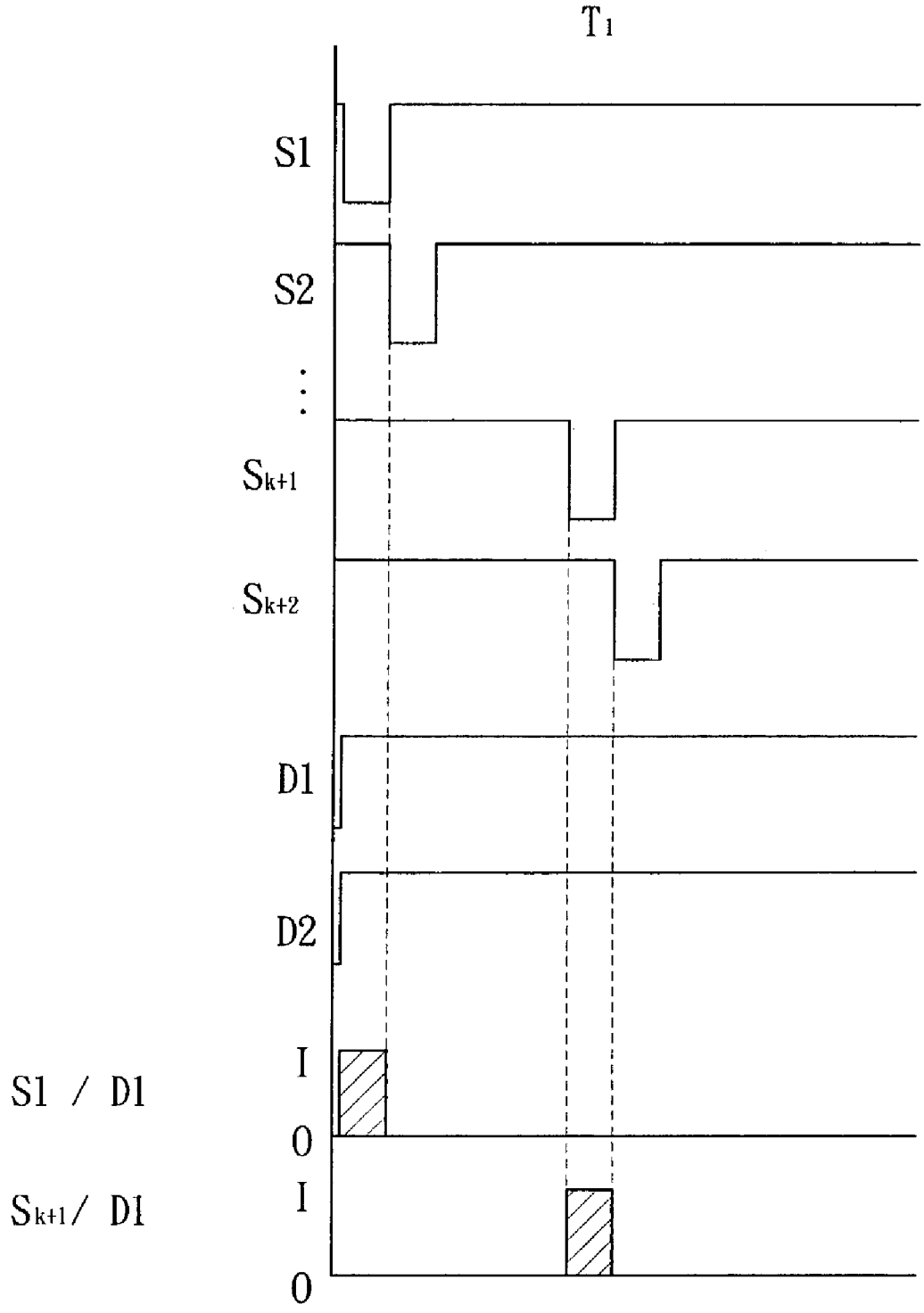
FIGS. 3A, 3B and 3C are schematic views of an embodiment of the invention, including driving signal wave forms of the scanning signals and data signals.
Figure 3B:
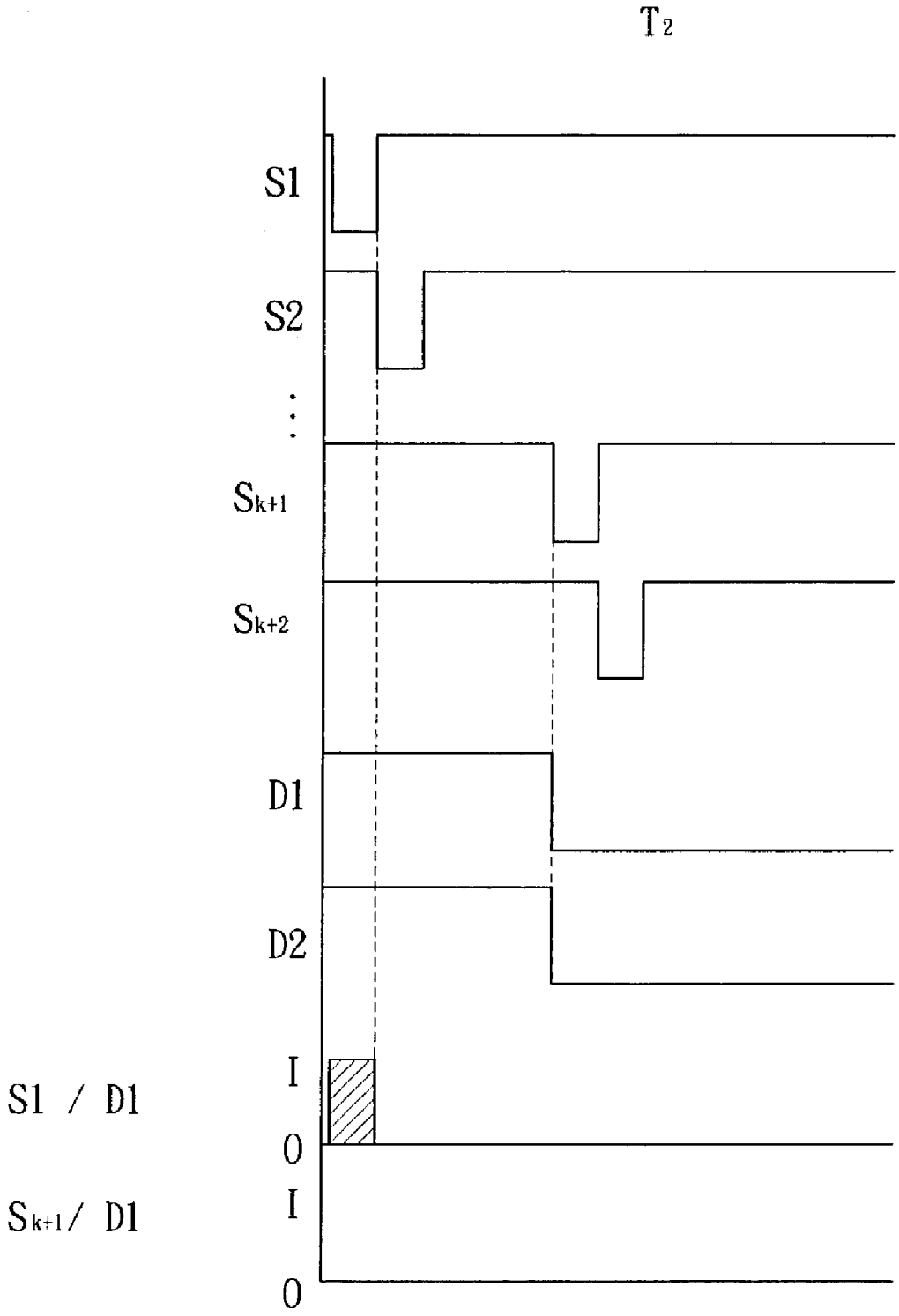
Figure 3C:
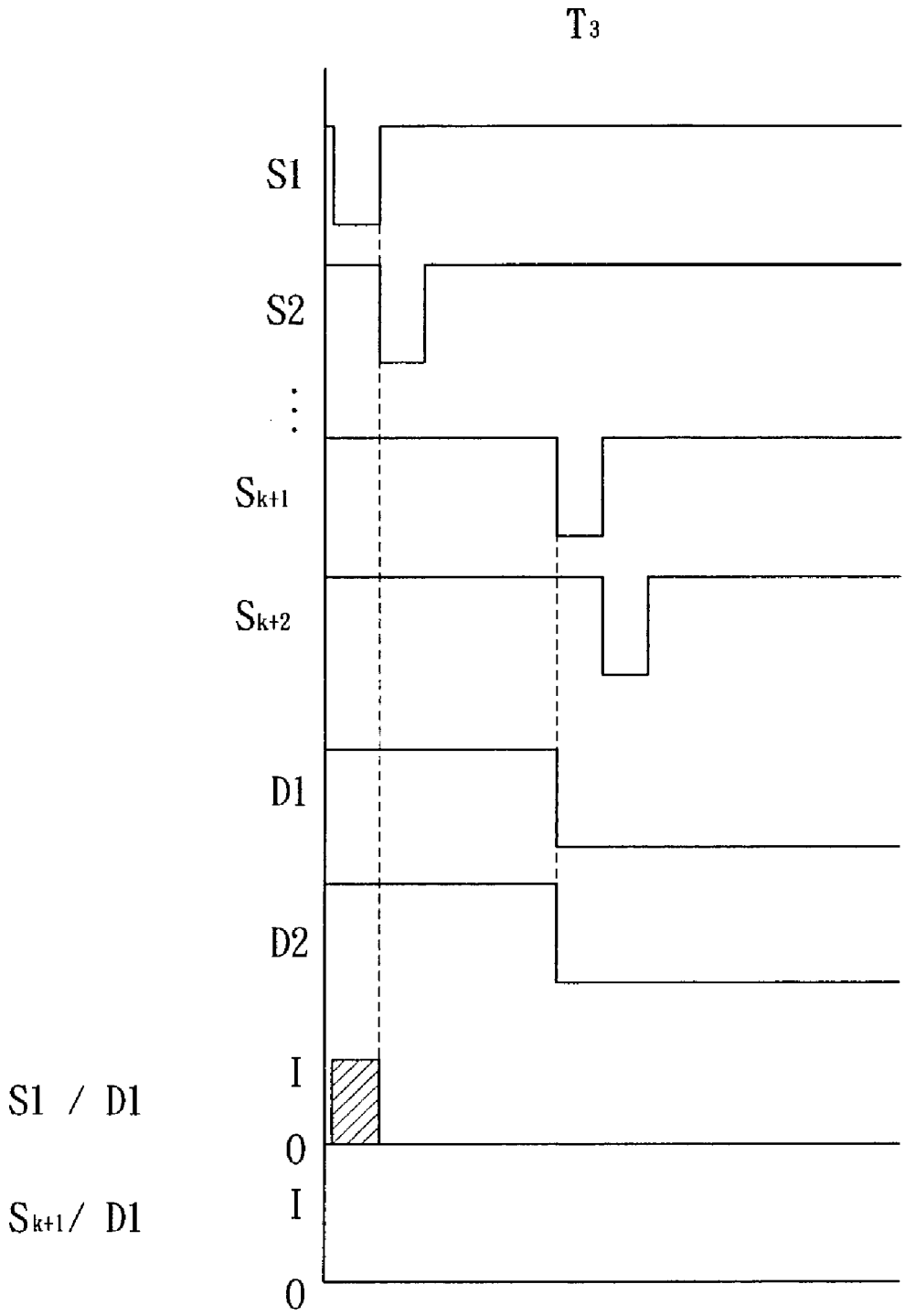

Refer to FIGS. 3A, 3B and 3C for an embodiment of the invention, including the driving signal wave forms of scanning signals and data signals. FIG. 3 is designed based on FIG. 1. It employs a luminous material 106 with three times of luminosity efficiency than the luminous material 104. According to the invention, a least common multiple 3 may be obtained. Then evenly divide the original scanning cycle of the scanning line driver circuit 110 to T1, T2 and T3 sub-scanning cycles. The sub-scanning cycles T1, T2 and T3 correspond respectively to FIGS. 3A, 3B and 3C. In the sub-scanning cycle T1, the luminous material 104 driven by scanning line S1 and the data line D1, and the luminous material 106 driven by scanning line S k+1 and the data line D1 are ignited sequentially. Their effective currents are S1/D1 and S k+1/D1. The shadow area indicates that illumination has been generated. In the sub-scanning cycle T2, the luminous material 104 driven by the scanning line S1 and the data line D1 is ignited again, but the luminous material 106 driven by the scanning line S k+1 and the data line D1 is not ignited. Their effective currents are S1/D1 and S k+1/D1. Similarly, in the sub-scanning cycle T3, only the luminous material 104 driven by the scanning line Si and the data line D1 is ignited. Their effective currents are S1/D1 and S k+1/D1. According to persistence of vision, the uniform luminosity of the picture viewed by human's eyes is caused by a plurality of overlapping original images that can enhance the gray level of the original image sensed by human eyes. The invention properly adjusts the illuminating times of different luminous materials based on their luminosity efficiency. The material which has a higher luminous efficiency is ignited with a fewer number of times, while the material which has a lower luminous efficiency is ignited with a greater number of times. Control of the ignition times for the luminous material is achieved by increasing the scanning frequency of the scanning line driver circuit and coupling with a pre-designed data line driving wave form. Details of the process have been explained previously, thus are omitted here.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart, from the spirit and scope of the invention.

What is claimed is:

1. A method for generating an uniform luminosity for an organic light emitting diode display device that has a plurality of scanning lines, a plurality of data lines, a plurality of luminous materials driven by the scanning lines and the data lines, a data line driver circuit to provide data signals to the data lines, and a scanning line driver circuit which has a scanning cycle T to provide scanning signals according to a selected scanning method to all scanning lines, comprising steps of:

obtaining the luminous efficiency Pi of every luminous material and calculating the least common multiple Pm thereof based on the luminous efficiency Pi;

dividing evenly the original scanning cycle T of the scanning line driver circuit by the least common multiple Pm to obtain Pm sub-scanning cycles to allow the scanning line driver circuit to scan sequentially and respectively all of the scanning lines in the Pm sub-scanning cycles; and providing data signals by the data line driver circuit to the data lines in every scanning cycle based on the every luminous efficiency Pi and the least common multiple Pm to drive every luminous material and driving every luminous material Pm/Pi times in the scanning cycle T, whereby uniform luminosity is generated.

2. The method of claim 1, wherein the luminous materials include at least a red light material, a blue light material and a green light material.

3. The method of claim 1, wherein the display device is a passive organic light emitting diode display device.

4. The method of claim 1, wherein the display device is an active organic light emitting diode display device.

5. The method of claim 1, wherein the scanning method is a sequential scanning method.

6. The method of claim 1, wherein the scanning method is an alternate scanning method.

* * * * *